US006474932B1

(12) United States Patent
Rush

(10) Patent No.: US 6,474,932 B1
(45) Date of Patent: Nov. 5, 2002

(54) ROD LOADER WITH TRANSFER MEMBER RAISED AND LOWERED IN CONCERT WITH ROD LIFT

(75) Inventor: William V. Rush, New Sharon, IA (US)

(73) Assignee: Vermeer Manufacturing Company, Pella, IA (US)

( * ) Notice: Subject to any disclaimer, the term of this patent is extended or adjusted under 35 U.S.C. 154(b) by 0 days.

(21) Appl. No.: 09/602,843

(22) Filed: Jun. 23, 2000

(51) Int. Cl.[7] ..... B65H 3/00

(52) U.S. Cl. ..... 414/798.1; 414/798; 414/745.7; 414/797.8

(58) Field of Search ..... 414/745.7, 798, 414/798.1, 797.8; 221/233, 236, 266

(56) References Cited

U.S. PATENT DOCUMENTS

| | | | |
|---|---|---|---|
| 3,984,007 A | 10/1976 | Birdwell | |
| 4,002,248 A | 1/1977 | Moller | |
| 4,632,618 A | 12/1986 | Issakainen | |
| 5,556,253 A | 9/1996 | Rozendaal et al. | |
| 5,607,280 A | 3/1997 | Rozendaal | |
| 5,687,804 A | 11/1997 | Lappalainen et al. | |
| 6,085,852 A | 7/2000 | Sparks et al. | |
| 6,179,065 B1 * | 1/2001 | Payne et al. | 175/24 |

FOREIGN PATENT DOCUMENTS

| | | |
|---|---|---|
| DE | 199 26 055 A1 | 12/2000 |
| EP | 0 984 132 A2 | 3/2000 |

* cited by examiner

*Primary Examiner*—Donald P. Walsh
*Assistant Examiner*—Jeffrey A Shapiro
(74) *Attorney, Agent, or Firm*—Merchant & Gould P.C.

(57) ABSTRACT

A horizontal directional drilling machine including a magazine, a feed member for indexing rods to and from the magazine, a rotational drive head for propelling rods into the ground, and a transfer mechanism for moving the rods between the rotational drive head and the feed member. The transfer mechanism includes a rod holder for holding the rods, and a drive mechanism for moving the holder between the rotational drive head and the feed member. The drilling machine also includes a lift unit for raising and lowering rods held within the columns of the magazine. The transfer mechanism is raised and lowered in concert with the lift unit.

15 Claims, 14 Drawing Sheets

ROD LOADER WITH TRANSFER MEMBER RAISED AND LOWERED IN CONCERT WITH ROD LIFT

FIELD OF THE INVENTION

The present invention relates generally to underground drilling machines. More particularly, the present invention relates to rod loaders for feeding rods to and from horizontal directional drilling machines.

BACKGROUND OF THE INVENTION

Utility lines for water, electricity, gas, telephone and cable television are often run underground for reasons of safety and aesthetics. Sometimes, the underground utilities can be buried in a trench that is later back filled. However, trenching can be time consuming and can cause substantial damage to existing structures or roadways. Consequently, alternative techniques such as horizontal directional drilling (HDD) are becoming increasingly more popular.

A typical horizontal directional drilling machine includes a frame on which is mounted a drive mechanism that can be slidably moved along the longitudinal axis of the frame. The drive mechanism is adapted to rotate a drill string (i.e., a length of interconnected rods) about its longitudinal axis. Sliding movement of the drive mechanism along the frame, in concert with the rotation of the drill string, causes the drill string to be longitudinally advanced into or withdrawn from the ground.

In a typical horizontal directional drilling sequence, the horizontal directional drilling machine drills a hole into the ground at an oblique angle with respect to the ground surface. During drilling, drilling fluid can be pumped through the drill string, over a drill head (e.g., a cutting or boring tool) at the end of the drill string, and back up through the hole to remove cuttings and dirt. After the drill head reaches a desired depth, the drill head is then directed along a substantially horizontal path to create a horizontal hole. After the desired length of hole has been drilled, the drill head is then directed upwards to break through the ground surface. A pull-back sequence is then initiated. During the pull-back sequence, a reamer is attached to the drill string, and the drill string is pulled back through the hole. As the drill string is pulled back, the reamer enlarges the hole. It is common to attach a utility line or other conduit to the drill string so that it is dragged through the hole along with the reamer.

A typical horizontal directional drilling machine includes a rod box (i.e., a rack or magazine) for storing rods (i.e., pipes or other elongated members) used to make the drill strings. A rod transfer mechanism is used to transport rods between the drive mechanism of the directional drilling machine and the rod box. During a drilling sequence, the rod transfer mechanism transports rods from the rod box to the drive mechanism. During a pull-back sequence, the rod transfer mechanism transports rods from the drive mechanism back to the rod box.

U.S. Pat. No. 5,607,280 discloses a prior art rod handling device adapted for use with a horizontal directional drilling machine. As shown in FIG. 1, the rod handling device includes a rod box 24 having five vertical columns 41–45. Bottom ends of the columns 41–45 are open so as to define five separate discharge openings 41*a*–45*a* through which rods can be fed. A selection member 50 is mounted beneath the discharge openings 41*a*–45*a*. The selection member 50 has five pockets 41*b*–45*b*, and functions to index or feed rods 20 to and from the rod box 24. For example, during a drilling sequence, the selection member 50 indexes rods 20 from the rod box 24 to a pickup location where the rods are individually picked up and carried to a rotational drive head 16 of the drilling machine by a transfer arm 51. During a pull-back sequence, the transfer arm 51 carries rods 20 from the rotational drive head 16 back to the pickup location, and the selection member 50 indexes the rods from the pickup location back beneath the rod box 24. To move the rods from the selection member 50 back into the rod box, a lift is used to push pipes upwardly into the columns 51–54 of the rod box 24.

During a typical drilling sequence, the rod box is unloaded starting with column 45. After column 45 has been unloaded, column 44 is unloaded. Thereafter, column 43, column 42 and column 41 are sequentially unloaded. During a pull-back sequence (i.e., a sequence in which rods are transferred from the drive head 16 back to the rod box 24), the columns are typically sequentially loaded starting with column 45 and finishing with column 41. Once column 45 has been loaded, a block or plug is manually inserted into pocket 45*b* of the selection member 50 to prevent additional rods from being loaded into column 45. Thereafter, column 44 is loaded. Once column 44 has been filled, a plug or block is manually inserted into pocket 44*b* of the selection member 50 to prevent additional rods from being loaded into column 44. Column 43 is then loaded. After column 43 has been loaded, a block or plug is inserted into pocket 43*b* of the selection member to prevent additional rods from being loaded into column 43, and column 42 is loaded. Once column 42 has been fully loaded, a block or a plug is manually inserted into pocket 42*b* of the selection member 50 to prevent additional rods from being loaded into column 42, and column 41 is loaded.

SUMMARY OF THE INVENTION

One aspect of the present invention relates to a horizontal directional drilling machine including a magazine, a feed member for indexing rods to and from the magazine, a rotational drive head for propelling rods into the ground, and a transfer mechanism for moving the rods between the rotational drive head and the feed member. The transfer mechanism includes a rod holder for holding the rods, and a drive mechanism for moving the holder between the rotational drive head and the feed member. The drilling machine also includes a lift unit for raising and lowering rods held within the columns of the magazine. The transfer mechanism is raised and lowered in concert with the lift unit. In one embodiment, the feed member has a plurality of upwardly opening pockets for receiving rods. In such an embodiment, a rod indexed from the magazine by the feed member is engaged by the rod holder of the transfer member, and then lifted from the feed member by lifting the transfer member with the lift unit. Rods held by the rod holder of the transfer member can be returned to the feed member by orienting the rod holder above at least one of the pockets of the feed member, and then lowering the transfer member with the lift unit.

A variety of advantages of the invention will be set forth in part in the description that follows, and in part will be apparent from the description, or may be learned by practicing the invention. It is to be understood that both the foregoing general description and the following detailed description are explanatory only and are not restrictive of the invention as claimed.

BRIEF DESCRIPTION OF THE DRAWINGS

The accompanying drawings, which are incorporated in and constitute a part of the specification, illustrate several aspects of the invention and together with the description, serve to explain the principles of the invention. A brief description of the drawings is as follows.

DETAILED DESCRIPTION

With reference now to the various drawings in which identical elements are numbered identically throughout, a description of various exemplary aspects of the present invention will now be provided.

I. Directional Drilling Machine

Figure 1:
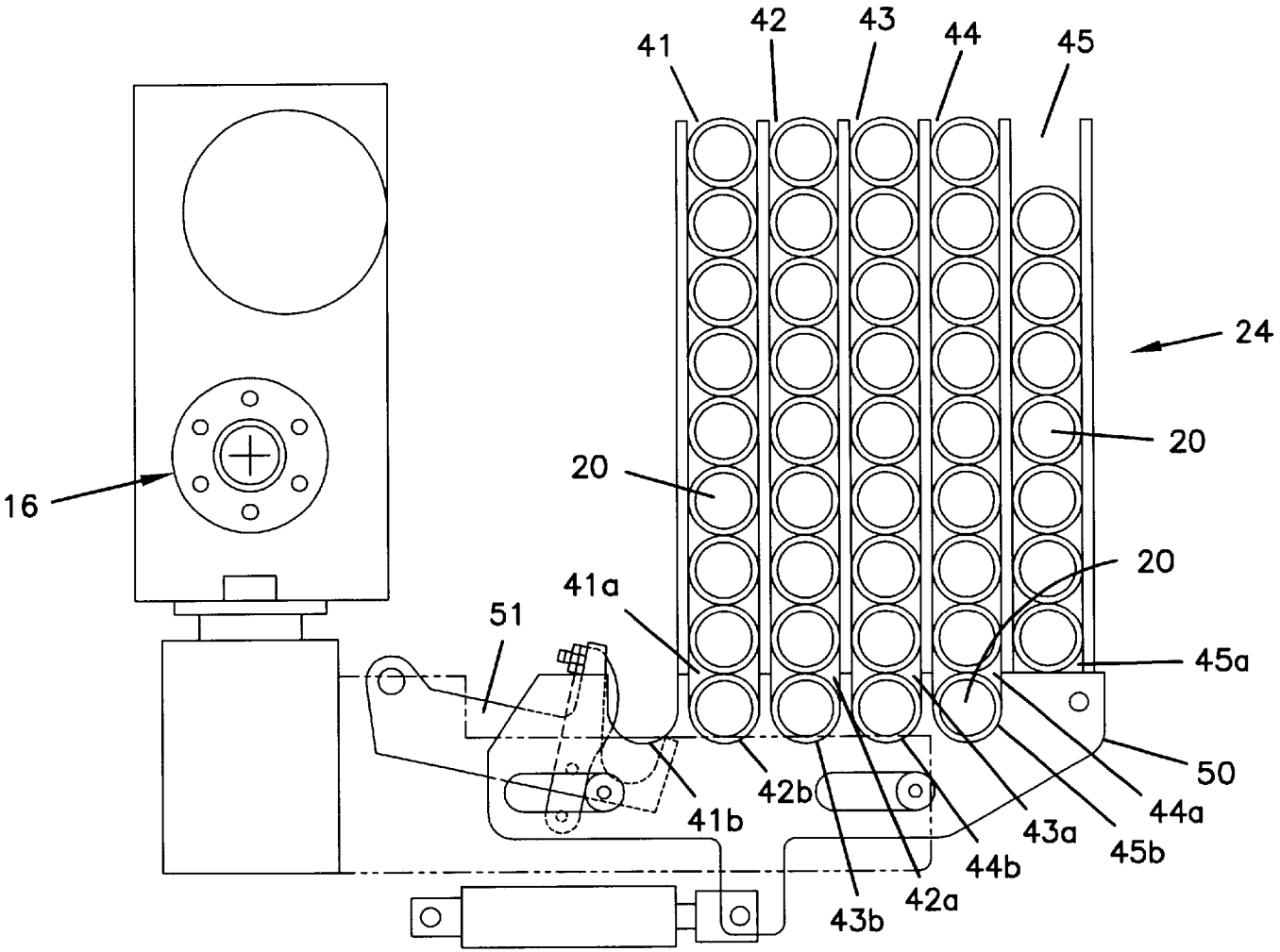
FIG. 1 PRIOR ART
FIG. 1 illustrates a prior art rod handling apparatus.
Figure 2:
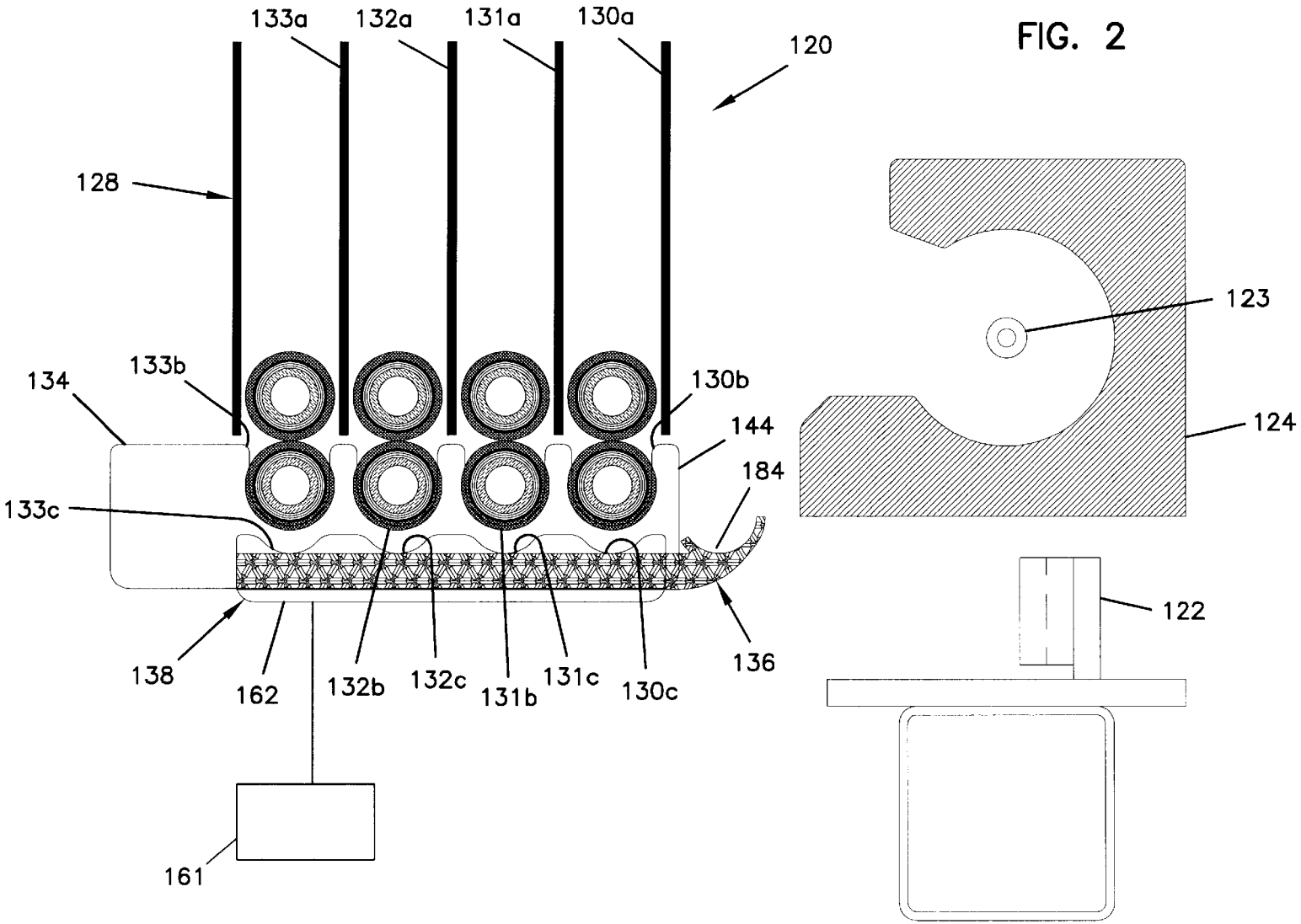
FIG. 2 schematically shows a directional drilling machine constructed in accordance with the principles of the present invention, a transfer mechanism of the drilling machine is shown in a lowered position.
Figure 3:
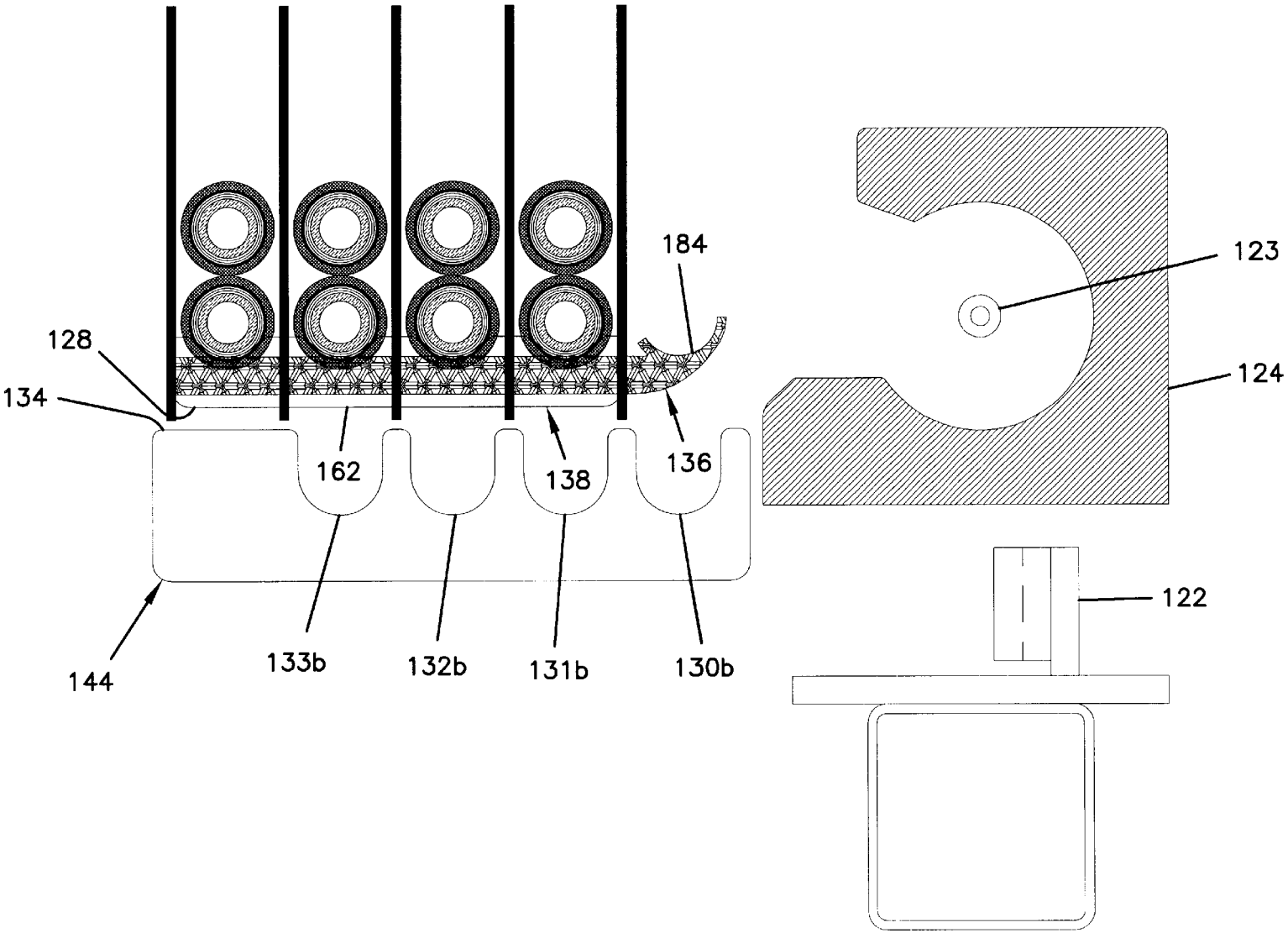
FIG. 3 shows the drilling machine of FIG. 2 with the transfer mechanism in a raised position.

FIGS. 2 and 3 illustrate a horizontal directional drilling machine 120 constructed in accordance with the principles of the present invention. The directional drilling machine 120 includes an elongated guide or track 122 that can be positioned by an operator at any number of different oblique angles relative to the ground. A rotational driver 124 (i.e., a drive head) is mounted on the track 122. The rotational driver 124 is adapted for rotating a drill string (i.e., a string of interconnected rods) in forward and reverse directions about a longitudinal axis of the drill string. The rotational driver 124 includes a drive chuck 123 for connecting the rotational driver to the drill string. Gripping units (e.g., vice grips or wrenches) can be provided adjacent the track 122 for use in coupling and uncoupling rods to the drive chuck 123. A thrust mechanism (not shown) is provided for: 1) pushing the rotational driver 124 down the track 122 to push a drill string into the ground during drilling operations; and 2) pulling the rotational driver 124 up the track 122 to pull a drill string from the ground during reaming/pull-back operations.

It will be appreciated that the above-described components are well known in the art and can have any number of different configurations. Exemplary prior art machines including such components are manufactured by Vermeer Manufacturing Company of Pella, Iowa. Further details regarding exemplary components suitable for use with the directional drilling machine 120 are provided in U.S. Pat. No. 6,357,537 issued Mar. 19, 2002 and entitled "Directional Drilling Machine and Method of Directional Drilling", which is hereby incorporated by reference.

Referring again to FIGS. 2 and 3, the horizontal directional drilling machine 120 also includes a removable rod box 128 (i.e., a magazine or rack) for storing the drilling rods. The rod box 128 defines four separate vertical rod storage columns 130*a*–133*a*. Each of the columns 130*a*–133*a* has an open lower end for allowing rods to be discharged from the rod box 128 and/or for allowing rods to be loaded back into the rod box 128. While four columns have been shown, it will be appreciated that the number of columns can be varied without departing from the principles of the present invention.

The directional drilling machine 120 also includes an indexing apparatus for feeding rods to and from the rod box 128. The indexing apparatus includes two spaced-apart feed members 144 positioned beneath the rod box 128. Only one of the feed members 144 is shown since the second feed member is spaced-apart from and hidden behind the depicted feed member 144. The feed members 144 (i.e., indexing members) include a plurality of upwardly opening pockets. Preferably, the number of pockets provided on each feed member 144 is equal to the number of columns provided in the rod box 128. For example, as best shown in FIG. 3, the depicted feed member 144 includes four pockets 130*b*–133*b* corresponding to the four columns 130*a*–133*a* of the rod box 128. The pockets 130*b*–133*b* are sized for receiving and holding rods. Each of the feed members 144 also includes a blocking element 134 positioned adjacent to the pocket 133*b*. The blocking elements can also be separate pieces mounted within or along side the feed members 144.

The feed members 144 are reciprocated back and forth beneath the rod box 128 (e.g., by a drive mechanism) to: 1) feed rods out from beneath the rod box 128 during drilling operations; and 2) feed rods back under the rod box 128 during pull-back operations. Each of the feed members 144 is preferably movable between a retracted position (shown in FIG. 4A) in which the pockets 130*b*–133*b* are respectively located beneath columns 130*a*–133*a*, and an extended position (shown in FIG. 4B) in which the feed members 144 have been displaced one column width to the right. In the extended position, the pocket 130*b* is laterally spaced from beneath the magazine 126 so as to be located at a "staging" or "pick-up" location 127.

The directional drilling machine 120 further includes a pair of lifts 138 (only one shown) for raising and lowering the rods located within the columns 130*a* 133*a* of the rod box 128. Only one of the lifts 138 is shown since the second lift is spaced-apart from and hidden behind the depicted lift. FIG. 3 shows the depicted lift 138 in a raised orientation in which the lowermost row of rods is located within the magazine 128, and FIG. 2 shows the lift 138 is a lowered position in which the lowermost row of rods is located beneath the magazine within the pockets 130*b*–133*b*.

The depicted lift 138 includes a rod support piece 162 that can be raised and lowered by any number of conventional structures 161 (see FIG. 2). The conventional structures 161 may include, for example, hydraulic cylinders, mechanical drives, electric actuator, hydraulic actuators, rack and pinion drives, and the like. The rod support piece 162 is preferably sized to extend at least beneath all of the columns 130*a*–133*a*. While the top side of the rod support piece 162 could be flat or any other shape, the top side preferably defines four rod cradling recesses 130*c*–133*c*. When the rod box 128 is mounted on the directional drilling machine 120, the pipe cradling recesses 130*c*–133*c* respectively align beneath the columns 130*a*–133*a* of the rod box 128.

Two transfer mechanisms 136 (only one shown) are provided for transferring rods between the feed members 144 and the rotational driver 124 of the directional drilling machine 120. Only one of the transfer mechanisms 136 is shown since the second transfer mechanism is spaced-apart from and hidden behind the depicted transfer mechanism. The transfer mechanisms 136 are operatively connected to or incorporated as part of the lifts 138. The phrase "operatively connected to" is understood to mean that the transfer mechanisms are either directly connected to the lifts 138, or connected to the lifts by an intermediate structure, frame, or linkage. For example, the transfer mechanisms 136 can be welded to the sides of the rod support pieces 162, or fastened to the sides of the support pieces 162 by conventional techniques such as bolts, screws, brackets, etc. In one embodiment, the transfer mechanism 136 includes a hydraulic cylinder having a cylinder portion connected to the support piece 162, and a piston rod forming an extendable transfer member. Preferably, the transfer mechanisms 136 are connected to the lifts 138 by any type of connection that causes the transfer mechanisms 136 to be raised and lowered in concert with the support pieces 162.

Referring to FIGS. 2 and 3, the depicted transfer mechanism 136 includes a transfer member 137 having a rod holder 184 defining a recess or full-pocket for receiving a rod. Alternatively, the holder can comprise a magnet (e.g., an electromagnet or a permanent magnet) or any number of different configurations such as mechanical grippers, suction type holders, etc. The transfer member 137 is moved between an extended orientation (shown in FIG. 4D) and a retracted orientation (shown in FIG. 4C) by a drive mechanism (e.g., a hydraulic cylinder connected to the rod holder 184 or any type of mechanical drive such as a motorized chain drive, belt drive or rack and pinion type-drive). Since the transfer mechanisms 136 are connected to the lifts 138, the transfer mechanisms 136 are raised and lowered by moving the lifts between the raised position (shown in FIG. 2) and the lowered position (shown in FIG. 3).

It will be appreciated that the specific configuration of the transfer members 137 can be varied as understood by one of skill in the art. For example, in alternative embodiments, the transfer members could be pivotally moveable or moveable along arcuate paths.

Figure 6A:
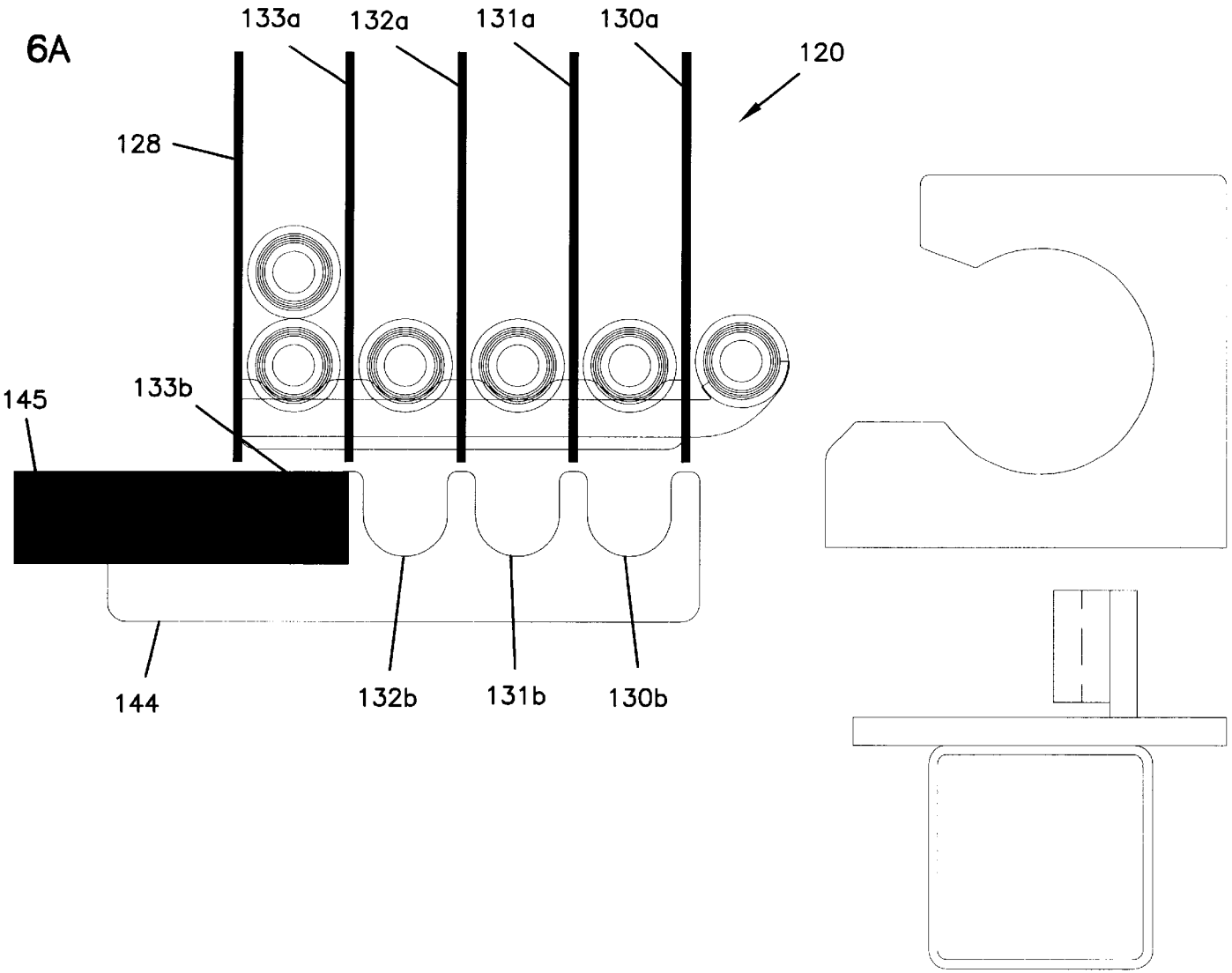
FIGS. 6A–6C illustrate various blocker positions for the directional drilling machine of FIGS. 2 and 3.
Figure 6B:
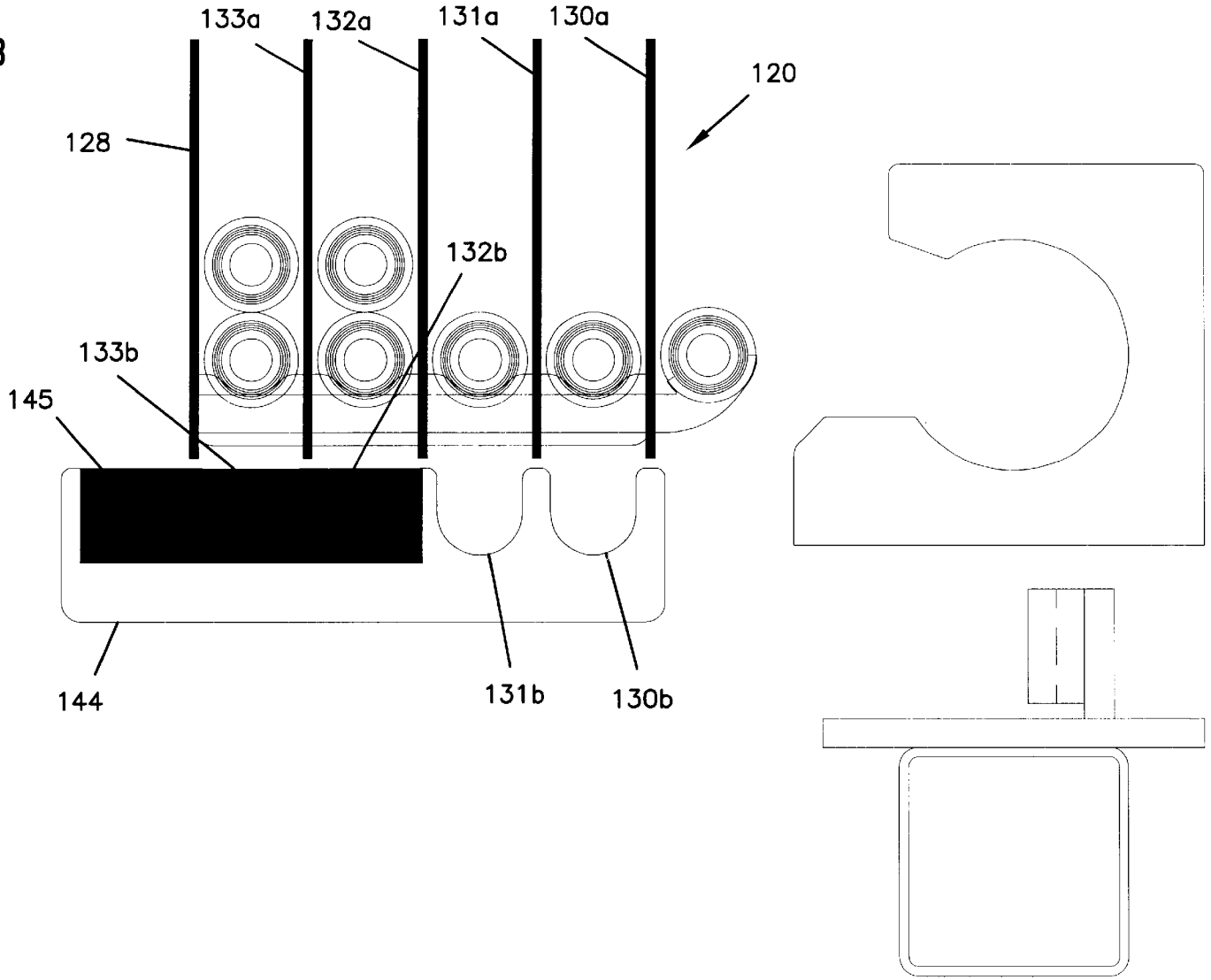
Figure 6C:
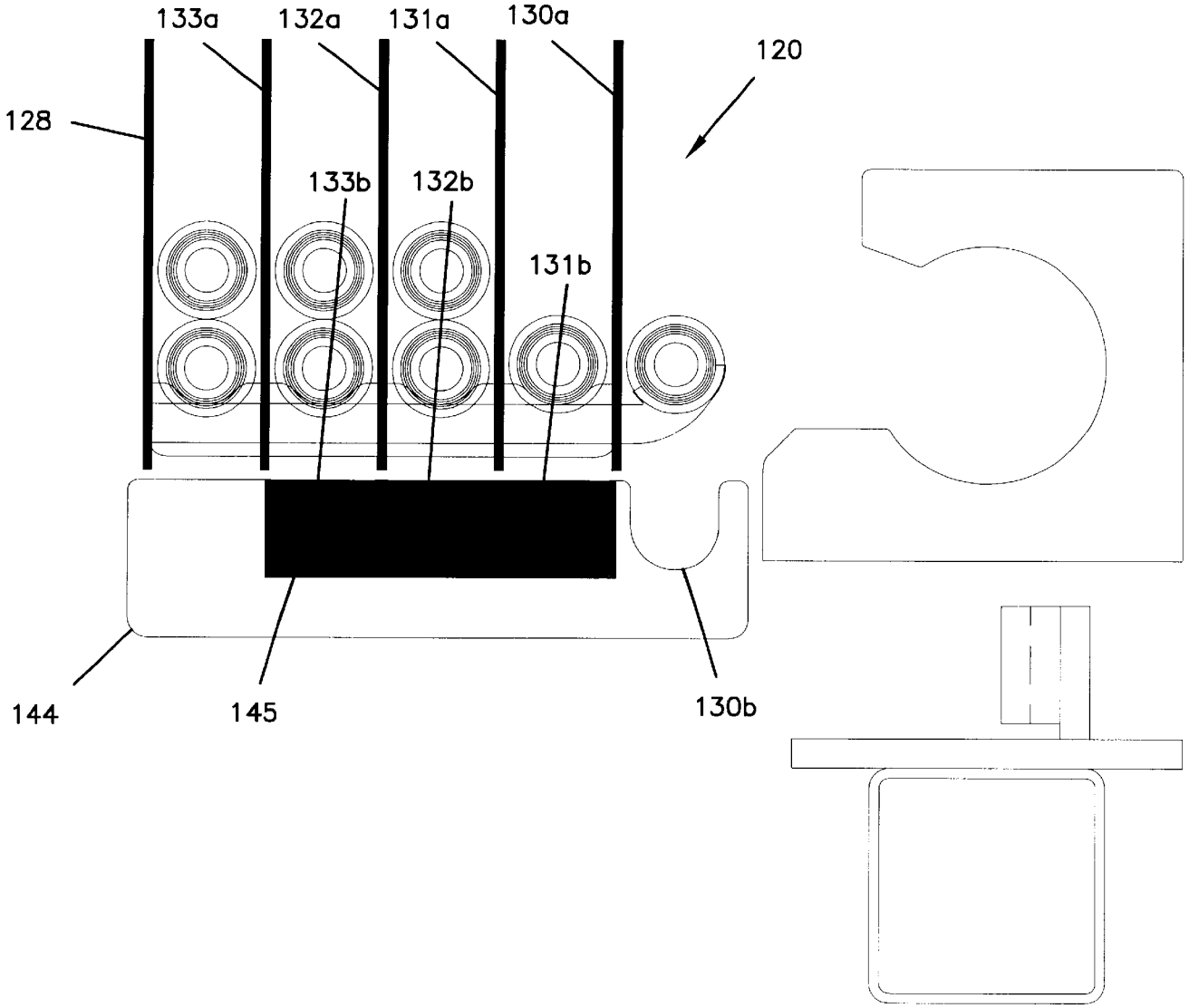

In certain embodiments, the directional drilling machine 120 can include elongated blockers 145 (see FIGS. 6A–6C) mounted within or along-side the feed members 144 for blocking one or more of the pockets 131*b*–133*b*, preferably as rods are loaded back into the rod box 128 during a pull-back cycle. For example, as each column is filled with rods, the pocket corresponding to the filled column is preferably blocked. In FIGS. 6A–6C, it is assumed that a column is full when the column contains two rods. Thus, FIG. 6A shows pocket 133*b* blocked after column 133*a* has been filled, FIG. 6B shows pockets 132*b* and 133*b* blocked after columns 132*a* and 133*b* have been filled, and FIG. 6C shows pockets 131*b*–133*b* blocked after columns 131*a*–133*a* have been filled. When the blocker 145 is fully retracted, all of the pockets 130*b*133*b* are open.

The blockers 145 can be moved relative to the feed members 144 by drive mechanisms such as hydraulic cylinders (not shown) interconnected between the blockers 145 and the feed members 144. Proximity sensors can be used at the tops of the columns 131*a*–133*a* for detecting when each of the columns is full. Preferably, a controller is used to automatically move the elongated blocker in response to signals from the sensors. Further details regarding the above-identified blocking system are described in U.S. patent application Ser. No. 09/602,036, entitled Blocking System for a Directional Drilling Machine, which was filed on a date concurrent with this application.

II. Sequence for Transferring Rods from Rod Box to Rotational Driver

Figure 4A:
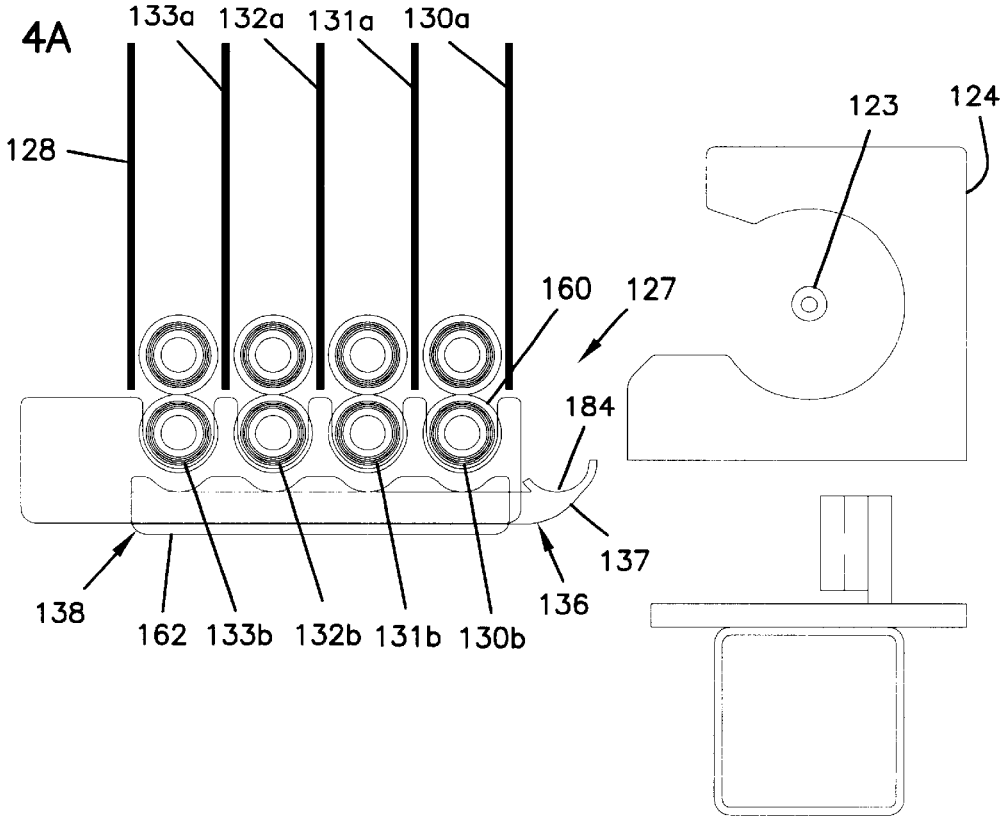
FIGS. 4A–4G illustrate a rod transfer sequence for moving a rod from the magazine to the rotational drive head of the directional drilling machine of FIGS. 2 and 3.

FIGS. 4A–4G illustrate a transfer sequence for moving rod 160 from the rod box 128 to the rotational driver 124 during a drilling operation. In FIG. 4A, rod 160 is located within pockets 130*b* of the feed members 144, and the feed members 144 are oriented in the retracted position in which pockets 130*b*–133*b* are positioned directly beneath respective columns 130*a*–133*a*. Also, the lifts 138 are lowered such that the lowermost row of rods in the rod box 128 is supported within the pockets 130*b*–133*b* of the feed members 144. Further, the rod transfer members 137 are retracted such that the rod holders 184 are located directly beneath the rod staging location 127.

Figure 4B:
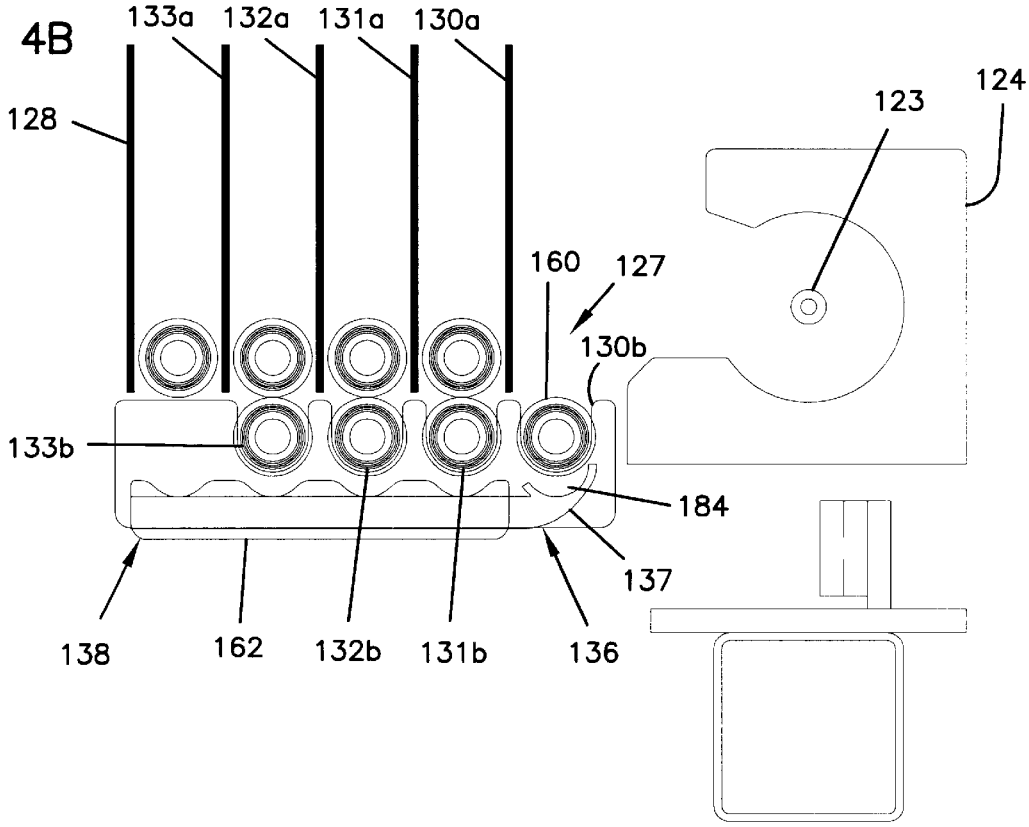
Figure 4C:
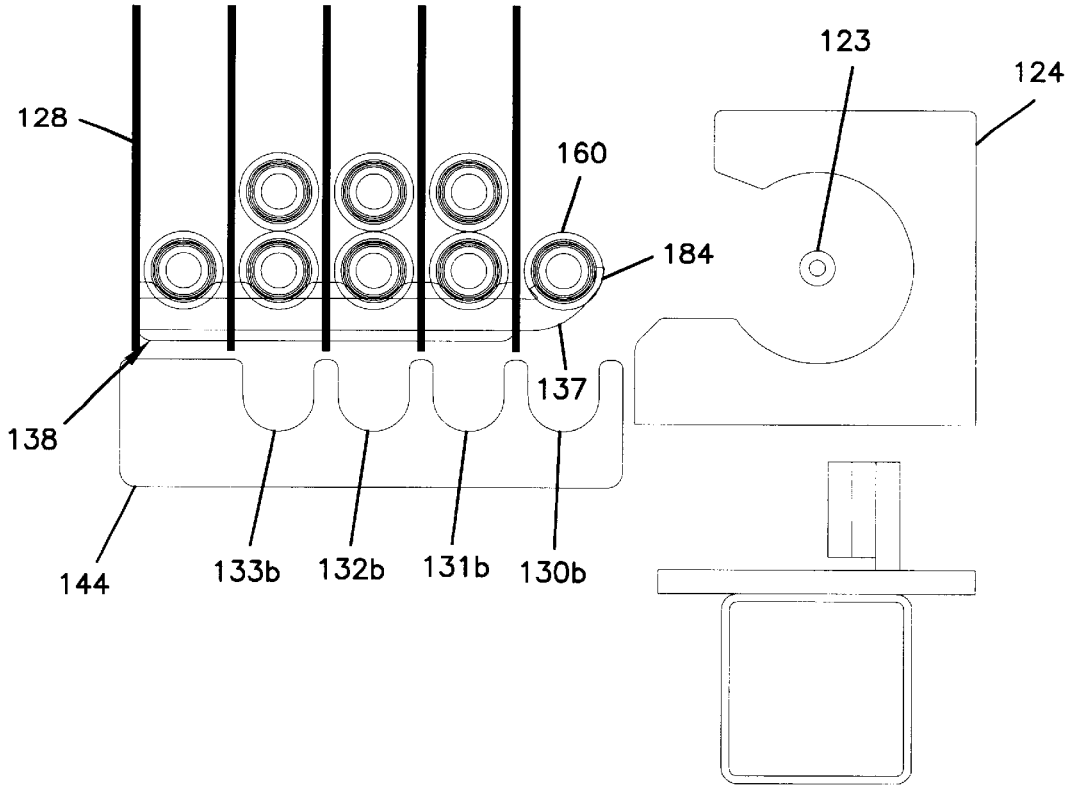

To initiate the transfer sequence, the feed members 144 are moved from the retracted position of FIG. 4A to the extended position as shown in FIG. 4B. In the extended position, the pockets 130*b* are positioned at the staging location 127. The staging location 127 is preferably offset at least one rod width from beneath the rod box 128. With the pockets 130*b* and the rod 160 held therein positioned at the staging location 127, the lifts 138 are raised as shown in FIG. 4C. By raising the lifts 138, the lowermost row of rods is lifted above the feed members 144 and into the rod box 128 (i.e., the rods of are lifted from the pockets 131*b*–133*b*). As the lifts 138 are raised, the transfer members 137 are concurrently raised causing the rod holders 184 to lift the rod 160 from the pockets 130*b*.

Figure 4D:
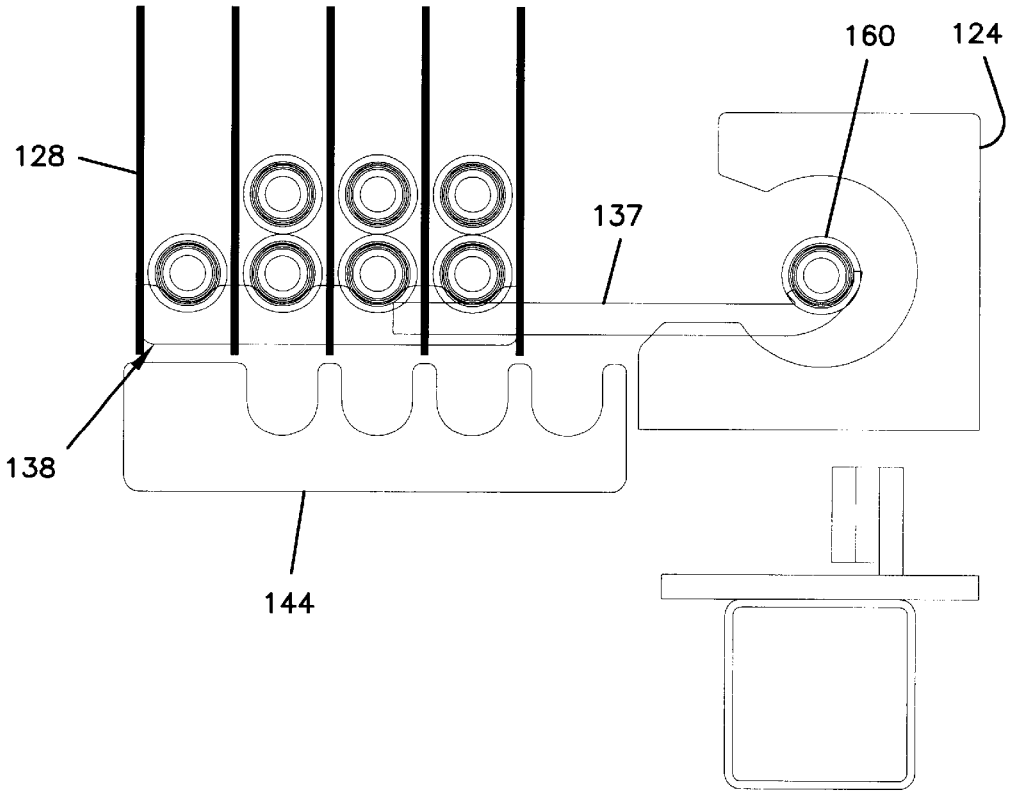
Figure 4E:
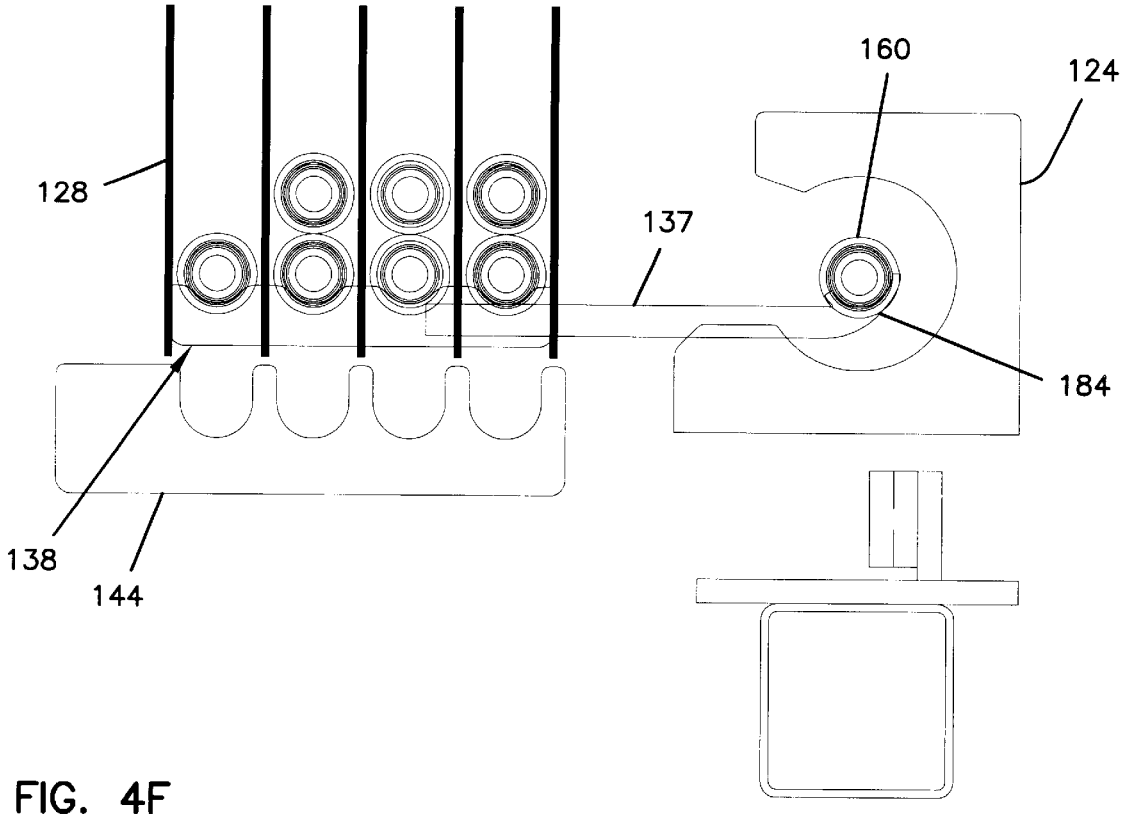
Figure 4F:
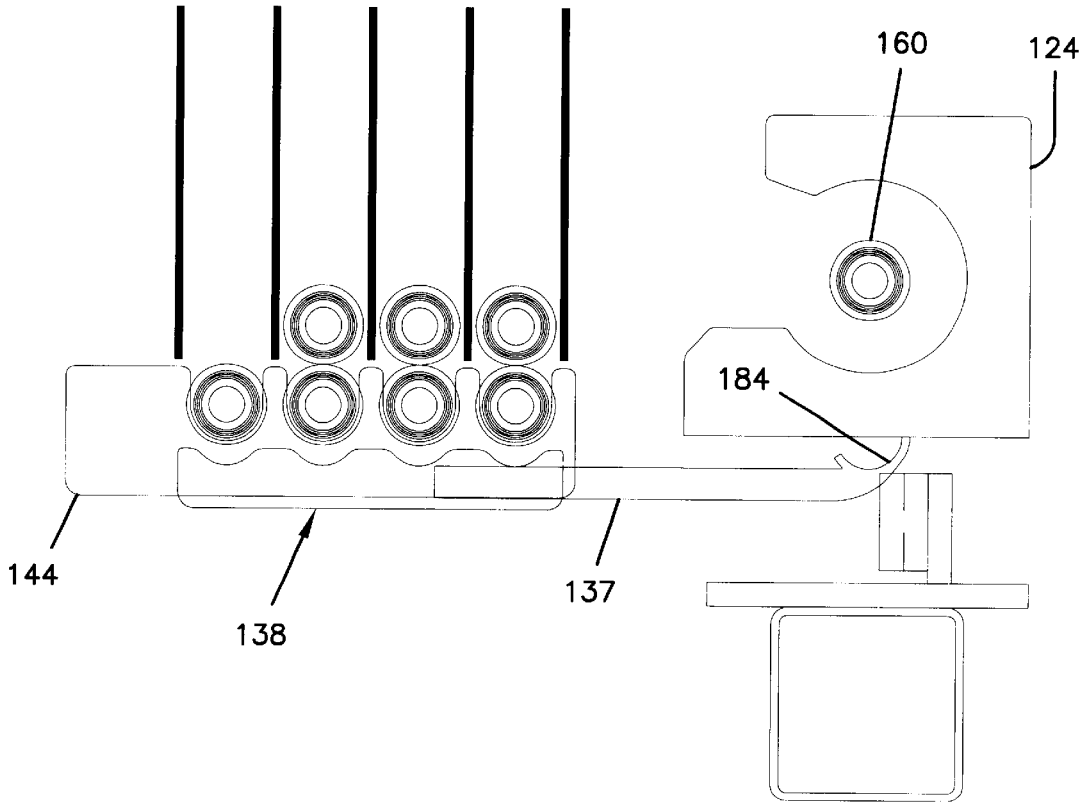
Figure 4G:
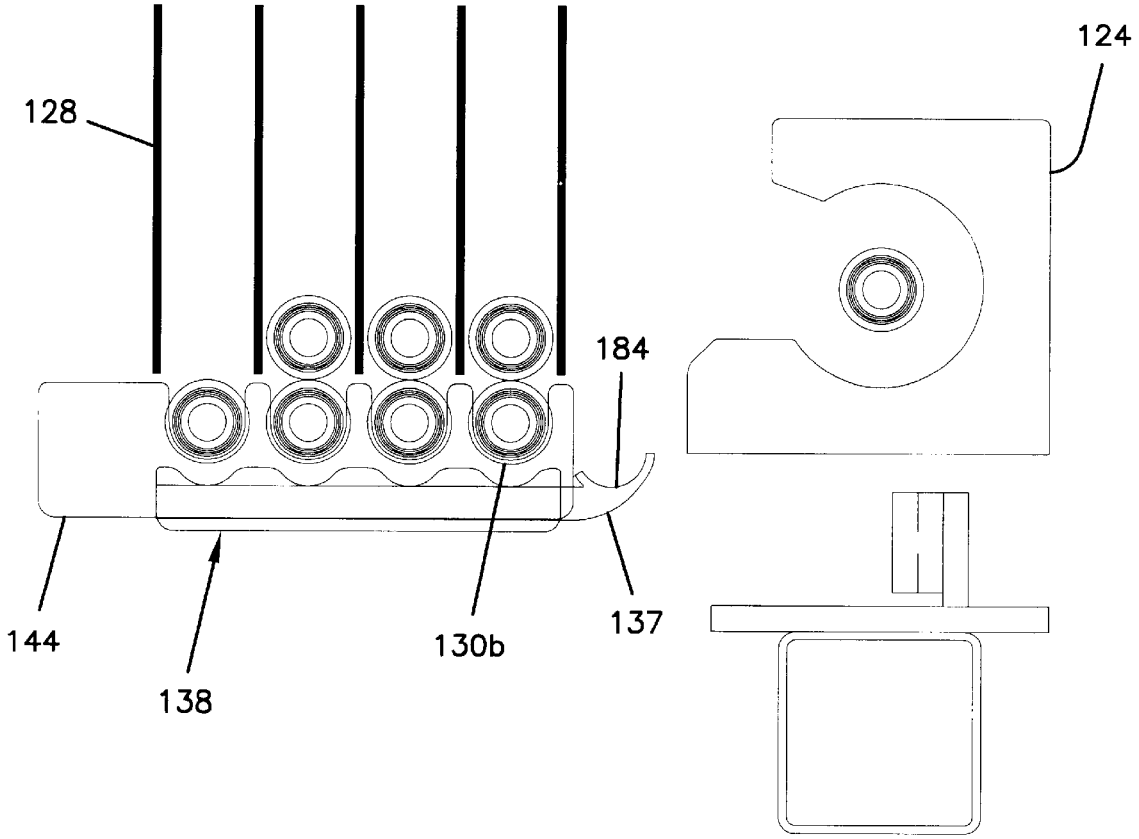

With the lifts 138 raised and the rod 160 held by the rod holders 184, the rod transfer members 137 are moved from the retracted position of FIG. 4C to the extended position of FIG. 4D. With the transfer members 137 extended, the rod holders 184 hold the rod 160 in alignment with the rotational driver thereby allowing the rod 160 to be coupled to the rotational driver. After the rod 160 has been coupled to the rotational driver, the feed members 144 are retracted beneath the rod box 128 as shown in FIG. 4E, and the lifts 138 are lowered as shown in FIG. 4F. By lowering the lifts 138, the transfer members 137 are lowered to displace the rods holders 184 from the rod 160. Finally, the transfer members 137 are returned to the retracted position as shown in FIG. 4G, and the cycle can be repeated to transfer the next rod (i.e., the rod held within pocket 130*b*) to the rotational driver 124.

Figure 5A:
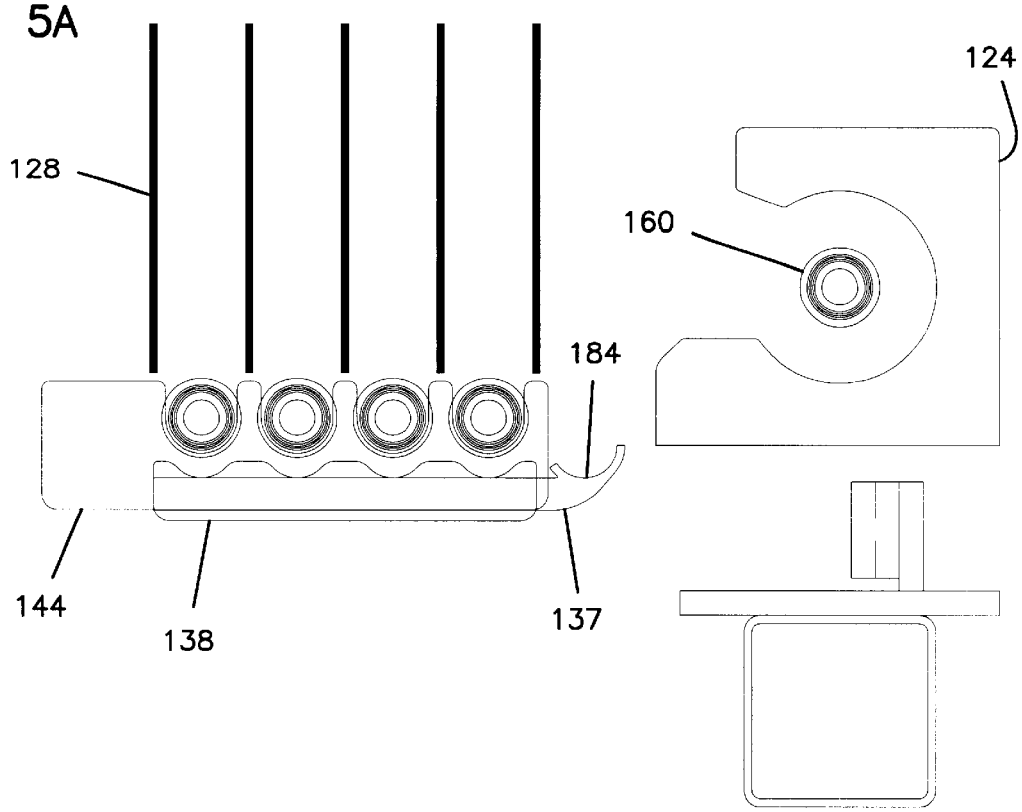
FIGS. 5A–5G illustrate a rod transfer sequence for returning a rod from the rotational drive head to the magazine of the directional drilling machine of FIGS. 2 and 3.
Figure 5B:
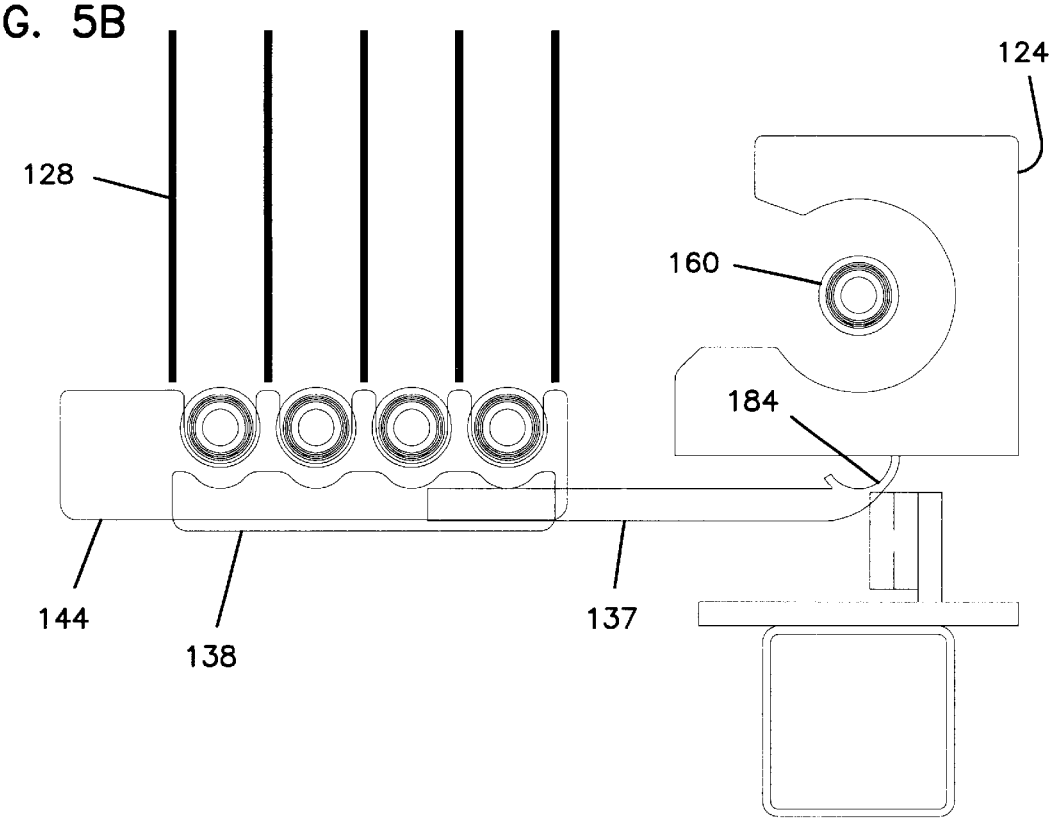
Figure 5C:
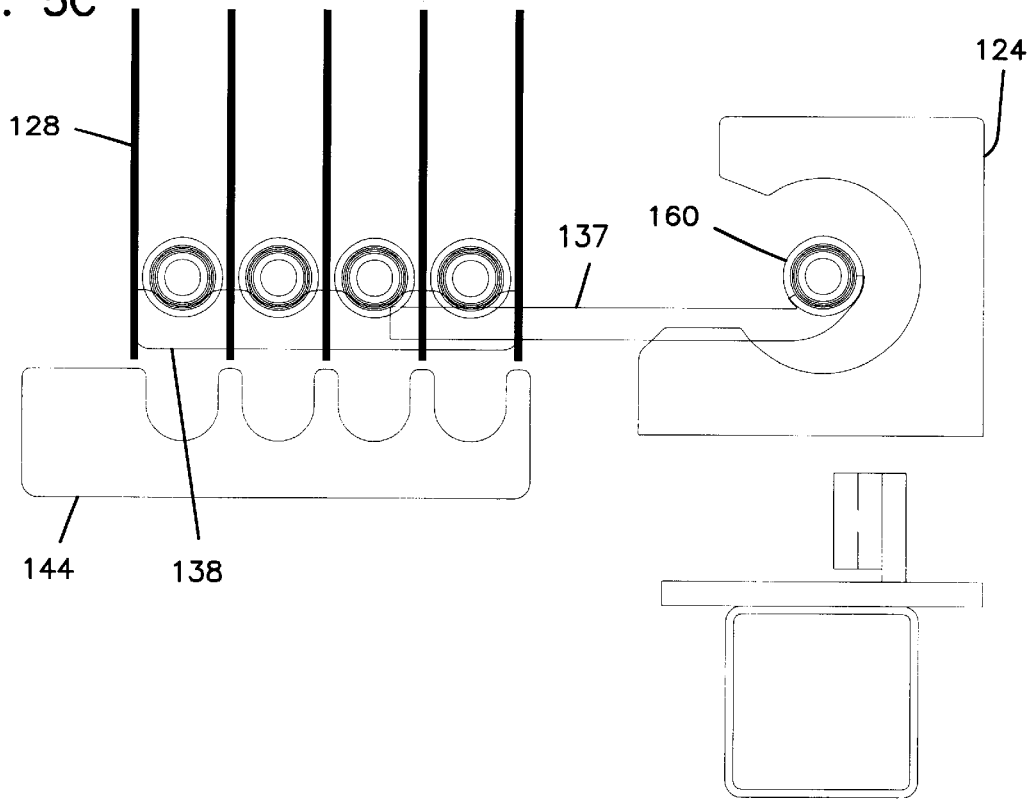
Figure 5D:
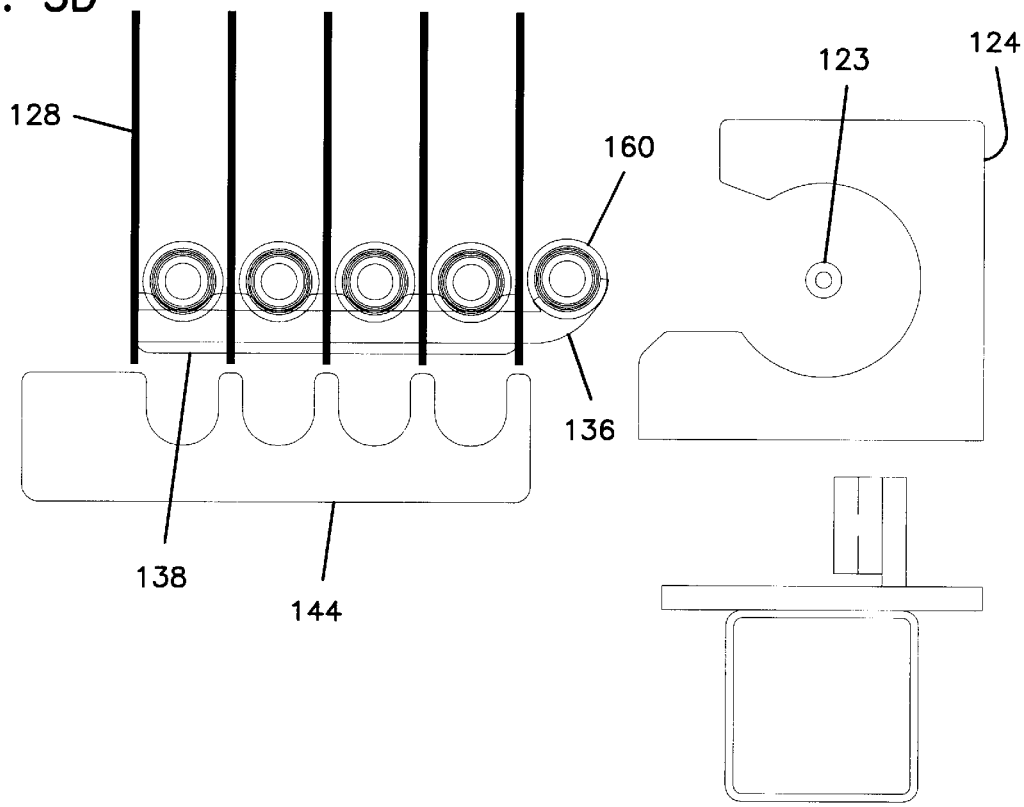
Figure 5E:
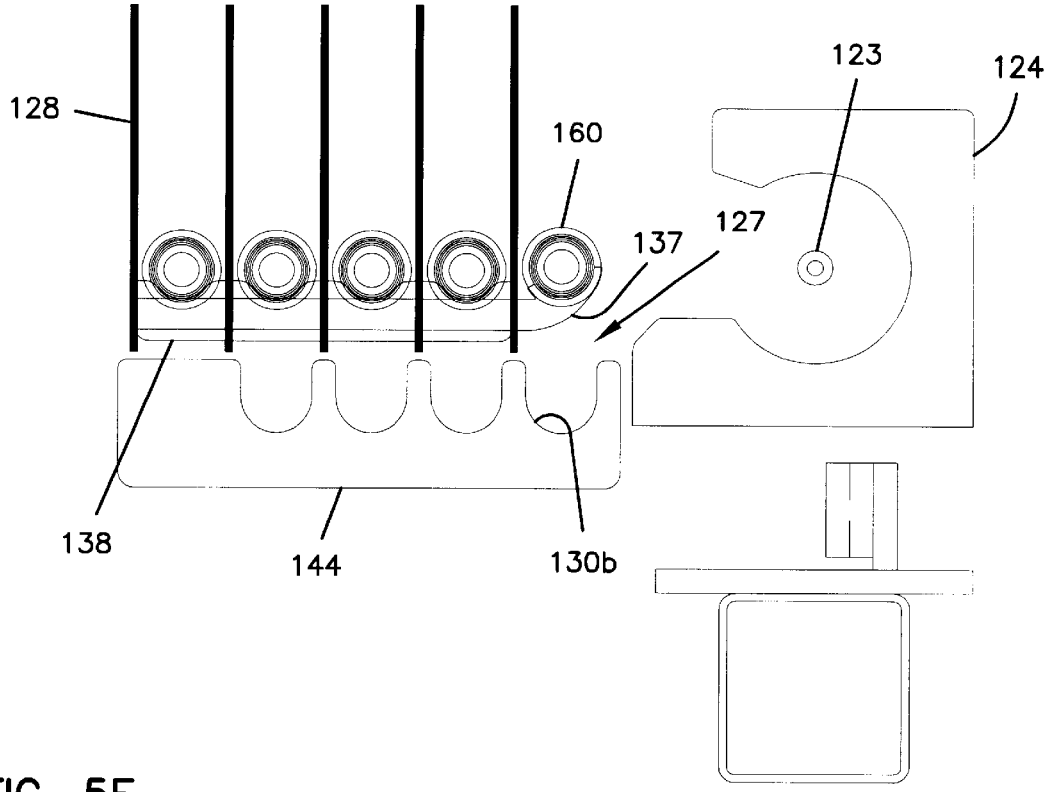
Figure 5F:
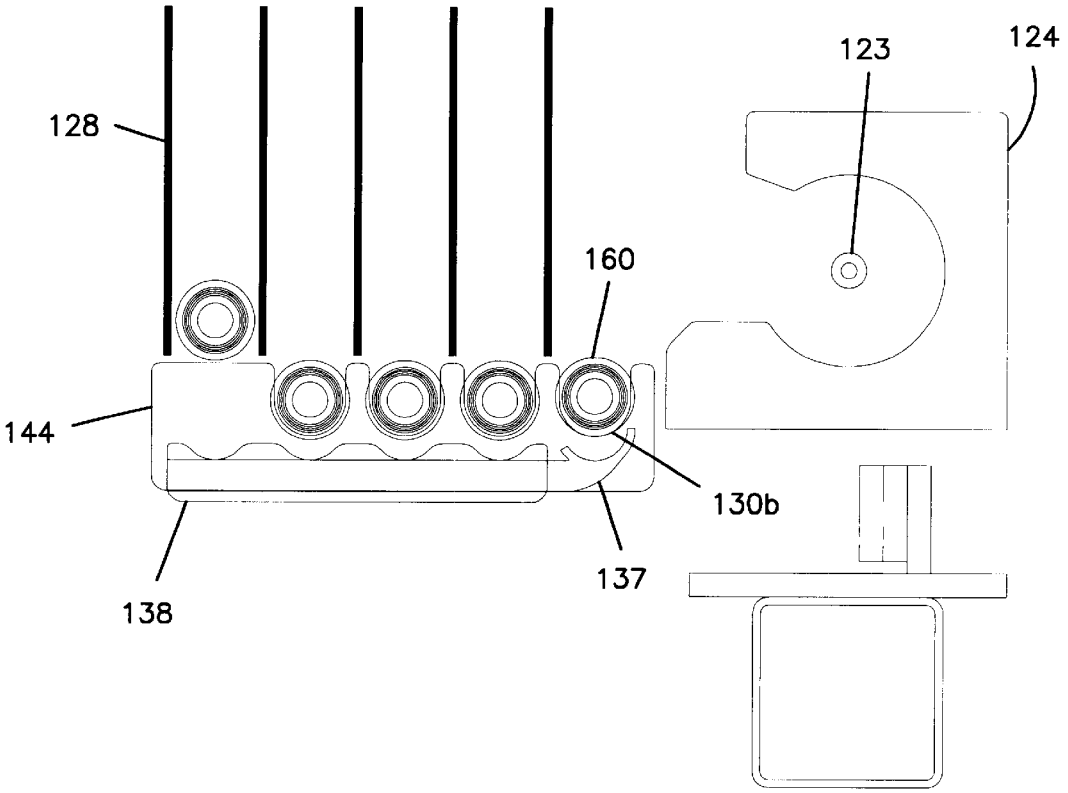
Figure 5G:
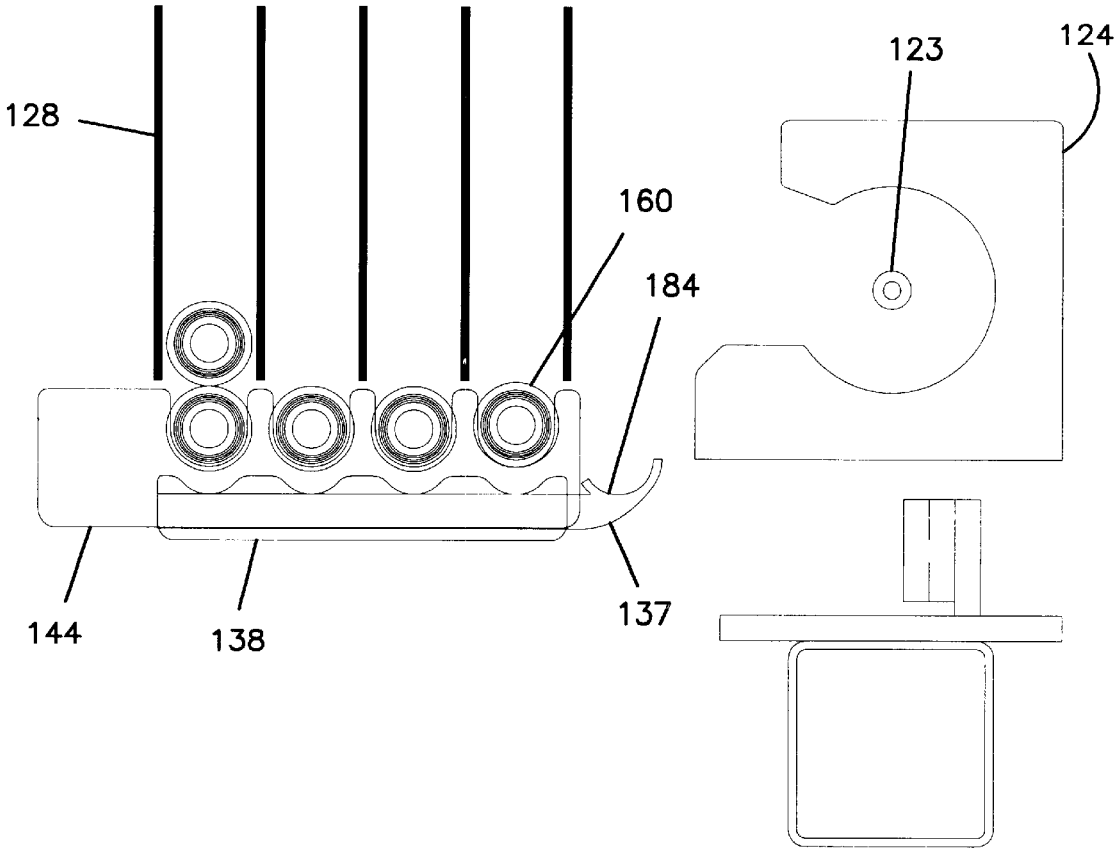

III. Sequence for Transferring Rods from Rotational Driver to Rod Box FIGS. 5A–5G illustrate a transfer sequence for transferring rod 160 from the drill string/rotational driver back to the rod box 128 during a pull-back sequence. As shown in FIG. 6A, rod 160 is located at the rotational driver 124, the feed members 144 and the transfer members 137 are retracted, and the lifts 138 are lowered. To initiate the sequence, the transfer members 137 are extended to place the rod holders 184 directly beneath the rod 160 as shown in FIG. 5B. Next, the lifts 138 are raised to bring the rod holders 184 into contact with the rod 160 as shown in FIG. 5C. The rod is then uncoupled from the drill string and the rotational driver 124, and the transfer members 137 are retracted as shown in FIG. 5D. Subsequently, the feed members 144 are extended as shown in FIG. 5E such that the pockets 130*b* are positioned at the staging location 127 directly beneath the rod 160. The lifts 138 are then lowered thereby lowering the rod 160 to the pockets 130*b* as shown in FIG. 5F. Thereafter, the feed members 144 are moved from the extended orientation to the retracted orientation as shown in FIG. 5G. The sequence is repeated to load additional rods into the rod box 128.

The above specification and examples provide a complete description of the manufacture and use of the composition of the invention. For example, in certain embodiments, a first lift unit may be used for vertically raising and lowering the transfer member, and a second lift unit may be used for raising and lowering rods within the rod box. Since many embodiments of the invention can be made without departing from the spirit and scope of the invention, the invention resides in the claims hereinafter appended.

What is claimed is:

1. A horizontal directional drilling machine comprising:

a magazine for holding a plurality of elongated rods, the magazine including a plurality of columns in which the rods are held, each of the columns having a separate bottom opening;

a feed member for feeding the rods to and from the magazine, the feed member including a plurality of upwardly opening pockets sized for receiving the rods, the feed member being moveable from a retracted position in which all of the pockets are positioned beneath the magazine to an index position in which at least one of the pockets is laterally offset from the magazine;

a lift unit for loading the magazine by lifting the rods from the pockets of the feed member up through the bottom openings of the columns;

a rotational drive head for propelling the rods into the ground; and a transfer mechanism for moving the rods between the rotational drive head and the feed members the transfer mechanism including a transfer member having a rod holder, and the transfer mechanism being mechanically operatively connected to the lift unit so as to be raised and lowered relative to the feed member by the lift unit.

2. The drilling machine of claim 1, wherein the lift unit includes a rod engaging portion that extends beneath all of the columns of the magazine.

3. The drilling machine of claim 2, wherein the rod engaging portion defines pipe cradling recesses positioned beneath each of the columns.

4. The drilling machine of claim 1, wherein the transfer member is moveable between an extended position in which the rod holder is located in general alignment with the rotational drive head, and a retracted position in which the rod holder is positioned adjacent to the magazine.

5. The drilling machine of claim 4, wherein the lift unit moves the transfer mechanism between a raised position in which the rod holder is located above the pockets of the feed member, and a lowered position in which the rod holder is located below the pockets of the feed member.

6. A horizontal directional drilling machine comprising:

a magazine for holding a plurality of elongated rods, the magazine including a plurality of columns in which the rods are held, each of the columns having a separate bottom opening;

a lift unit for loading rods into the magazine through the bottom openings, the lift unit including a rod support structure having portions positioned beneath all of the columns of the magazine, the lift unit including a lift drive for raising and lowering the rod support structure;

a rotational driver for propelling the rods into the ground; and a transfer mechanism including a transfer member having a rod holder, the transfer mechanism being mechanically coupled to the rod support structure so as to be raised and lowered by the lift drive when the rod support structure is raised and lowered, and the transfer member being moveable relative to the lift unit between a first position in which the rod holder is in general alignment with the rotational driver, and a second position in which the rod holder is positioned adjacent to the magazine.

7. The directional drilling machine of claim 6, wherein the transfer member is extended and retracted between the first and second positions.

8. The directional drilling machine of claim 6, wherein the rod holder comprises a pocket sized for receiving a rod.

9. A horizontal directional drilling machine comprising:

a magazine for holding a plurality of elongated rods, the magazine including a plurality of columns in which the rods are held, each of the columns having a separate bottom opening;

a rotational driver for propelling the rods into the ground;

a transfer mechanism for moving the rods between the magazine and the rotational driver, the transfer mechanism including a transfer member having a rod holder, the transfer member being moveable between an extended position in which the rod holder is positioned adjacent to the rotational driver, and a retracted position in which the rod holder is positioned adjacent to the magazine; and a lift unit, the lift unit including a rod support structure positioned beneath the magazine, and a lift cylinder that vertically raises and lowers both the rod support structure and the transfer mechanism relative to the magazine.

10. The horizontal directional drilling machine of claim 9, wherein the lift unit includes a rod support structure having portions positioned beneath all of the columns of the magazine.

11. The horizontal directional drilling machine of claim 10, wherein the lift unit can concurrently lift the transfer member and the rods within the magazine.

12. A method for moving a rod from a magazine to a rotational driver of a directional drilling machine, the magazine including a plurality of columns having lower openings, the directional drilling machine including a lift unit for lifting rods into the columns through the lower openings, the lift unit including a lift member having portions positioned beneath all of the columns of the magazine, the directional drilling machine further including a transfer mechanism having a rod holder, the transfer mechanism being mounted to the lift member, the method comprising:

positioning a rod at a location offset from the magazine;

positioning the rod holder beneath the offset rod;

actuating the lift unit to lift both the offset rod positioned within the rod holder and the rods within the magazine; and conveying the lifted offset rod and rod holder to a position in general alignment with the rotational driver.

13. The method of claim 12, wherein the rod holder comprises a pocket.

14. A method for loading a rod into a magazine, the magazine including a plurality of columns having lower openings, the directional drilling machine including a lift unit for lifting rods into the columns through the lower openings, the lift unit including a lift member that extends beneath all of the columns of the magazine, the directional drilling machine further including a transfer mechanism having a transfer member, the transfer mechanism being mounted to the lift member, the method comprising:

moving the rod from a drill string to a staging position that is laterally offset from the magazine, the rod being moved by the transfer member that holds the rod;

actuating the lift unit to lower both the rod held by the transfer member, and the rods within the magazine;

conveying the lowered rod from the staging position to a position located beneath one of the lower openings of one of the columns of the magazine; and lifting the rod through the lower opening of the column with the lift unit.

15. The method of claim 14, wherein the method comprises a pocket.

* * * * *

UNITED STATES PATENT AND TRADEMARK OFFICE

CERTIFICATE OF CORRECTION

PATENT NO. : 6,474,932 B1
DATED : November 5, 2002
INVENTOR(S) : Rush

It is certified that error appears in the above-identified patent and that said Letters Patent is hereby corrected as shown below:

Column 4,
Line 46, “actuator, hydraulic” should read -- actuators, hydraulic --

Column 5,
Line 45, “130*b*133*b*” should read -- 130*b*-133*b* --

Column 7,
Line 21, “feed members the” should read -- feed member, the --

Signed and Sealed this

First Day of July, 2003

JAMES E. ROGAN
*Director of the United States Patent and Trademark Office*